US007150234B2

(12) United States Patent
Gilman et al.

(10) Patent No.: US 7,150,234 B2
(45) Date of Patent: Dec. 19, 2006

(54) FINLESS TRAINING PROJECTILE WITH IMPROVED FLIGHT STABILITY OVER AN EXTENDED RANGE

(75) Inventors: Stewart Gilman, Budd Lake, NJ (US); Anthony Farina, Hackettstown, NJ (US); Leon Manole, Great Meadows, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 70 days.

(21) Appl. No.: 10/711,714

(22) Filed: Sep. 30, 2004

(65) Prior Publication Data

US 2006/0065149 A1 Mar. 30, 2006

(51) Int. Cl.
*F42B 10/24* (2006.01)

(52) U.S. Cl. ..... 102/517; 102/501; 102/529; 244/3.24

(58) Field of Classification Search ..... 102/501, 102/517, 529; 244/3.23, 3.25
See application file for complete search history.

(56) References Cited

U.S. PATENT DOCUMENTS 463,922 A * 11/1891 Russell ..... 244/3.23
5,070,791 A * 12/1991 Dineen et al. ..... 102/517
5,164,538 A * 11/1992 McClain III ..... 102/517
5,328,130 A * 7/1994 Gilman et al. ..... 244/3.23
5,498,160 A * 3/1996 Farina et al. ..... 434/12
5,725,179 A * 3/1998 Gilman et al. ..... 244/3.24
6,123,289 A * 9/2000 Manole et al. ..... 244/3.24

* cited by examiner

*Primary Examiner*—Michael J. Carone
*Assistant Examiner*—Bret Hayes
(74) *Attorney, Agent, or Firm*—Michael C. Sachs; John F. Moran

(57) ABSTRACT

A finless cone-nosed, ogival-nosed, or combination ogive-cone nosed training projectile is statically stable, yet has adequate spin rate to compensate for aerodynamic or mass asymmetries. In addition, the training projectile can be fired from smooth bore or rifled cannons of various calibers, including 120 mm and 105 mm. Spin torque and stability augmentation are provided by a radially angled slotted tail flange attached to the rear of the training projectile, providing high performance and improved accuracy at low cost for use in training exercises. The training projectile has a higher static margin than conventional devices, and provides the ability to train personnel with a training projectile that achieves flight ranges similar to its matching tactical projectile, and has improved accuracy.

11 Claims, 3 Drawing Sheets

FINLESS TRAINING PROJECTILE WITH IMPROVED FLIGHT STABILITY OVER AN EXTENDED RANGE

FEDERAL RESEARCH STATEMENT

The inventions described herein may be manufactured, used and licensed by or for the U.S. Government for U.S. Government purposes.

BACKGROUND OF THE INVENTION

FIELD OF THE INVENTION

The present invention generally relates to training munitions for training military personnel. In particular, the present invention relates to a finless training projectile that develops spin in flight from radially angled slots in a slotted tail piece.

The military has many different types of projectiles of tank and artillery rounds. In addition, new projectiles of tank and artillery rounds are continually being developed. For each operating projectile, an identically shaped training cartridge is required for use in training personnel who will use the real or tactical projectile.

The performance of training projectiles should correspond to the matching real or tactical projectile as closely as possible. Conventional training rounds utilize folding or fixed fin training round designs to achieve a ballistic match to tactical (service) projectiles. Although this technology has proven to be useful, it would be desirable to present additional improvements. What is needed is a training projectile with improved static margin and reduced sensitivity to center of pressure shift that can be fired from smooth bore and rifled cannons of various calibers, including 120 mm and 105 mm. The need for such a training round has heretofore remained unsatisfied.

SUMMARY OF THE INVENTION

A finless, cone-nosed, ogival-nosed, or combination ogive-cone nosed training projectile is statically stable, yet has adequate spin rate to compensate for aerodynamic or mass asymmetries. In addition, the finless, cone-nosed training projectile can be fired from smooth bore or rifled cannons of various calibers, including 120 mm and 105 mm. Spin torque and stability augmentation are provided by a radially angled slotted tail flange attached to the rear of the finless, nose-coned projectile. Design of the slotted tail flange can be tailored to provide a ballistic match to tactical projectiles.

The finless training projectile provides high performance at low cost for use in training exercises. Although conventional spike-nose training projectiles have proven to be satisfactory for their intended purpose, the present finless training projectile provides a higher stability throughout its flight regime.

More specifically, the finless training projectile maintains a higher static margin than the conventional spike-nose training projectile due to the following two improvements. The first being that the center of gravity for the flight projectile has been moved further forward. The second is that the center of pressure remains in a constant rearward position, throughout the Mach number range encountered during flight. This combination of physical features provides greater flight stability for enhanced target accuracy.

Propellant for training projectiles is provided in a cartridge attached to a base of the training cartridge. Any fins or other flight stabilizing features on the base of training projectiles intrude into the cartridge. The finless, cone-nosed training projectile requires relatively little space in the cartridge, freeing up space in the cartridge for propellant. Consequently, a less energetic, more economical propellant can be used, further reducing training costs and improving performance.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 1:
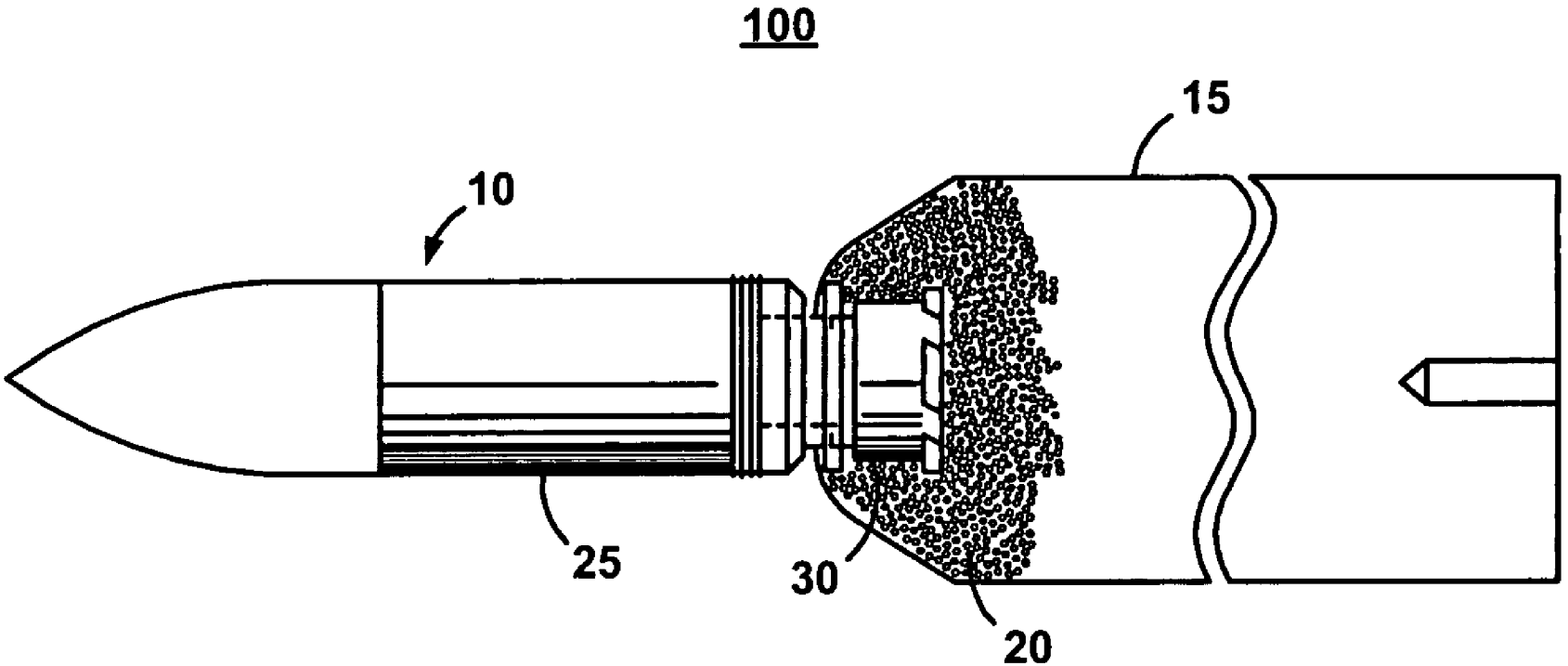
FIG. 1 is a cross-sectional view of an exemplary training cartridge in which a finless, training projectile of the present invention can be used.

FIG. 1 is a cross-sectional diagram of a training cartridge 100 comprising a finless, ogival-nosed training projectile 10 (also referenced herein as projectile 10) according to the present invention. The training cartridge 100 comprises a canister 15 and a propellant 20. The projectile 10 comprises a body 25 and a tail 30.

Figure 2:
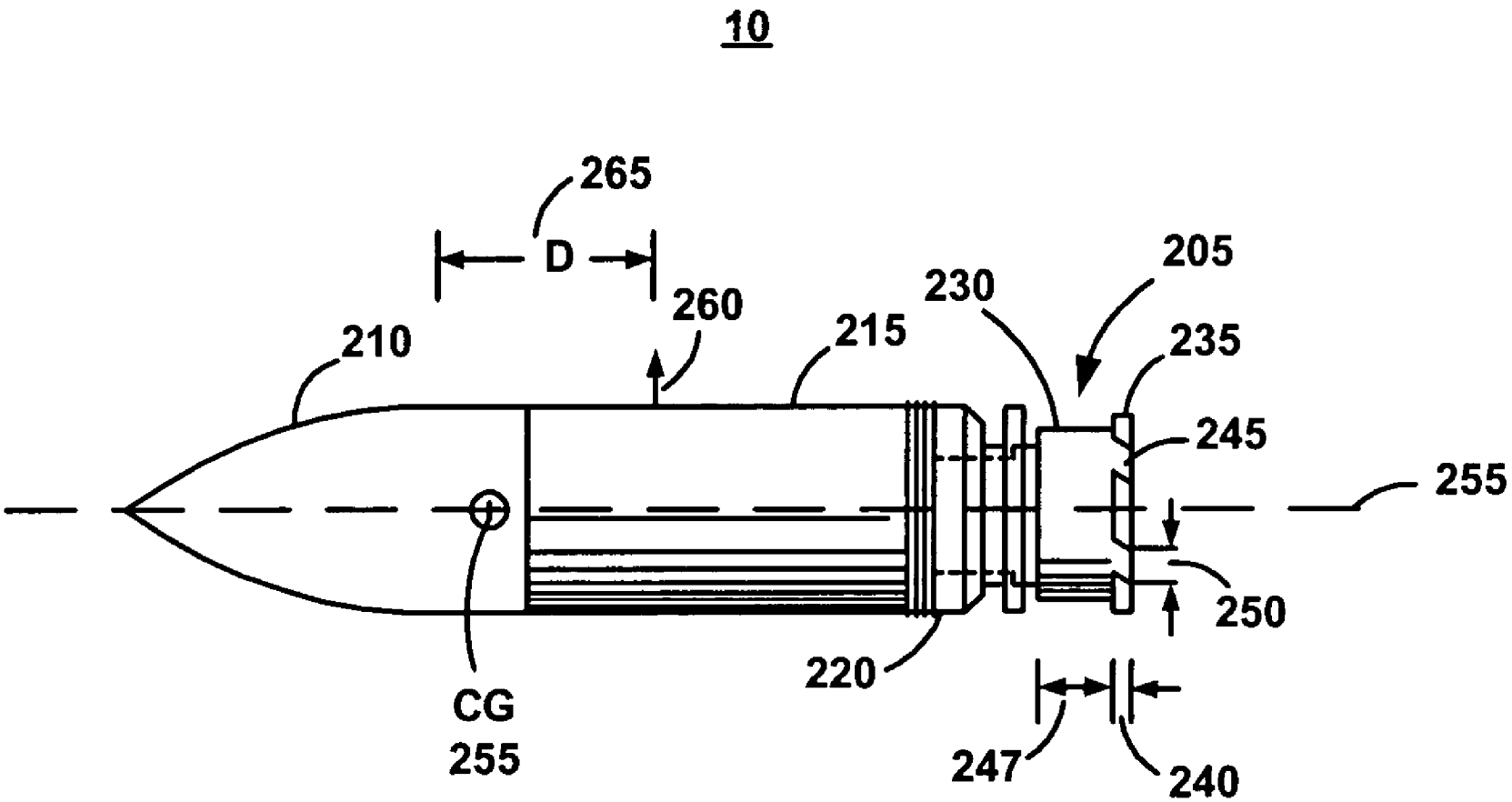
FIG. 2 is a side view of the exemplary finless training projectile of FIG. 1.

FIG. 2 is a diagram of projectile 10. Reference is made to U.S. Pat. No. 005,238,130, which is incorporated herein in its entirety. A stabilizer 205 of the projectile 10 is shown attached to the rearwardmost (tail) end of the projectile 10. Projectile 10 may be, for example a tank round for a 120 mm smooth bore system. Stabilizer 205 ensures that the projectile spins when fired from such a smooth bore or non-rifled system. Projectile 10 possesses a nose forwardmost (front) portion 210 and a rearward or aft cylindrical portion 215 having stabilizer 205 attached thereto. The diameter of cylindrical portion 215 is slightly smaller than the inside diameter of the bore of tube from which the projectile is fired. Obturator 220, fastened about the cylindrical portion of the projectile 10 provides a friction fit between the bore of the cannon and projectile 10 to prevent forward thrust gasses from escaping from the bore prior to the escape of the projectile 10 when fired. The projectile 10 and the stabilizer 205 have a common longitudinal axis 225.

The stabilizer 205 as shown is cylindrical having two distinct diameters and a single longitudinal axis 225. For simplicity, stabilizer 205 can be characterized by two integrally connected, adjacent and coaxial cylindrical segments 230 and 235. Segment or flange 235 has a diameter slightly smaller than the inner diameter of the bore of the cannon from which the projectile is fired. That is, the diameter of segment 235 is equal to, or substantially equal to, the diameter of the largest cylindrical portion of the projectile 10. For instance, if the projectile 10 is for a 120 mm smooth bore system, the largest cylindrical portion of projectile 10 (other than obturator 220) has a diameter of approximately 119.3 mm, which is substantially the dimension of the diameter of cylindrical segment 235.

Unless stated otherwise, any dimension recited herein is a dimension for a 120 mm smooth bore system.

Segment 235 has an axial length 240 of approximately 10.1 mm, and a periphery of segment 32 has equally spaced, circumferentially positioned, angled slots 245 or air flow-through channels, which traverse the length of segment 235. The angled slots 245 are defined by substantially parallel side walls separated by a surface which is either planar or arcuate shaped. The slot width 250, or more accurately the perpendicular distance between slot walls, is approximately 18.1 mm. As shown, side walls of the slots are negatively sloped, relative to the longitudinal axis 225 of segments 230 and 235, creating angled slots 245.

The stabilizer for a 120 mm caliber projectile has six circumferentially, equally spaced apart angled slots 245 which are positioned equiangularly, i.e., every sixty degrees about the periphery of segment 235 with slot walls being angled at thirty degrees relative to longitudinal axis 225.

The number of angled slots 245 is not critical, as long as the number is greater than one and the slots are positioned symmetrically about the periphery of segment 235; nor is the angle of the slot walls, relative to the longitudinal axis 225, critical as long as the angle is between zero and ninety degrees. Preferably, the angle is between fifteen and seventy-five degrees and most preferably, for the 120 mm caliber system, the angle is thirty degrees. It has been determined that the number of slots on the stabilizer is directly proportional to the time required for a projectile to reach a steady state, i.e., a constant rate of spin, and the angle of the walls determines the spin rate. The projectile 10 shown in FIG. 2 having stabilizer 205 attached thereto with six equally spaced apart slots 245 and slot walls angled at thirty degrees, relative to the longitudinal axis 225 of the segments 230 and 235, and traveling faster than the speed of sound, will spin at a rate of twenty-five revolutions per second. The steady state is reached in seconds.

As illustrated by FIG. 2, the stabilizer 205 can be connected to the rear end of an ogive-nosed shaped projectile and may be made in dimensions to fit a projectile of any smooth bore system. In operation, as a projectile exits the bore of the non-rifled cannon, above the speed of sound, air passes over cylindrical segment 230 and is directed through angled slots 245 on the periphery of cylindrical segment 235. As shown in FIG. 2, the walls of slots 245 have a negative slope and as air passes through slots 245 the projectile 10 spins in a clockwise direction (when viewed from the rear). Reversing the slope of the walls of slots 245 will force the projectile to rotate in the counter clockwise direction.

Adjacent, integrally connected, and coaxial to cylindrical section or flange 235 is cylindrical section 230. Cylindrical section 230 has a diameter smaller than the diameter of cylindrical section 235 and an axial length 247 longer than the axial length 240 of cylindrical section 235. The diameter of cylindrical section 230 is approximately 102.6 mm, and the axial length 247 is approximately 43.6 mm. The difference in diameters between cylindrical segments 235 and 240 defines the depth of slots 245.

The device reaches a steady state or a constant spin rate in a matter of seconds, and this spin rate is accomplished by reducing the conventional length of a prior art projectile without the need for fins extending beyond the diameter of the projectile. The device as described may be machined from a solid piece of aluminum or other light and malleable metal. Slots may be cut into the metal using a router bit.

A center of gravity (CG) 255 is indicated for projectile 10 on FIG. 2. A center of pressure 260 is further indicated for projectile 10. The ogival shaped nose 210 provides increased mass to move the center of gravity 255 to a forward position on projectile 10. The ogival shaped nose 210 further allows the center of pressure to remain in a constant position during flight. Consequently, a distance D 265 between the center of gravity 255 and the center of pressure 260 remains constant during flight, providing improved flight stability over an extended range of flight.

Figure 5:
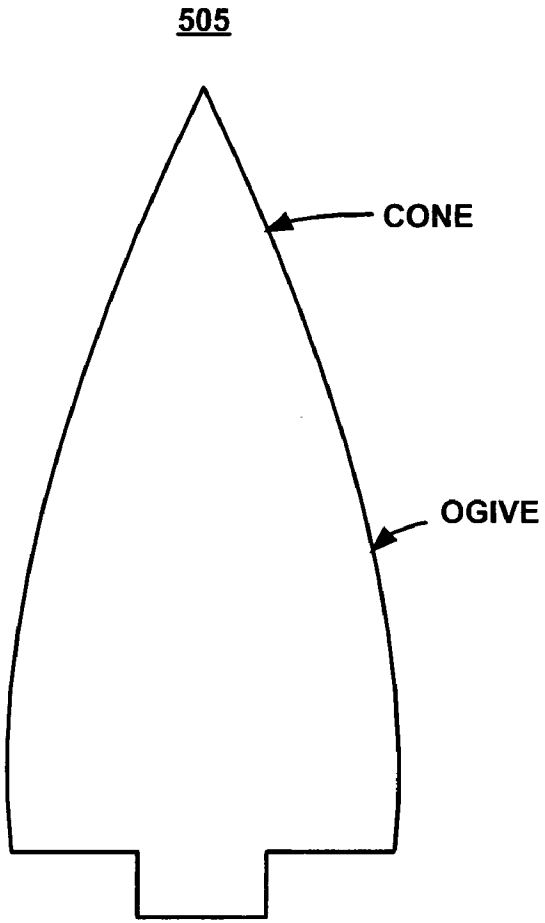
FIG. 5 is a side view of a combination cone-ogive shaped nose for use in the training projectile of FIG. 1.
Figure 4:
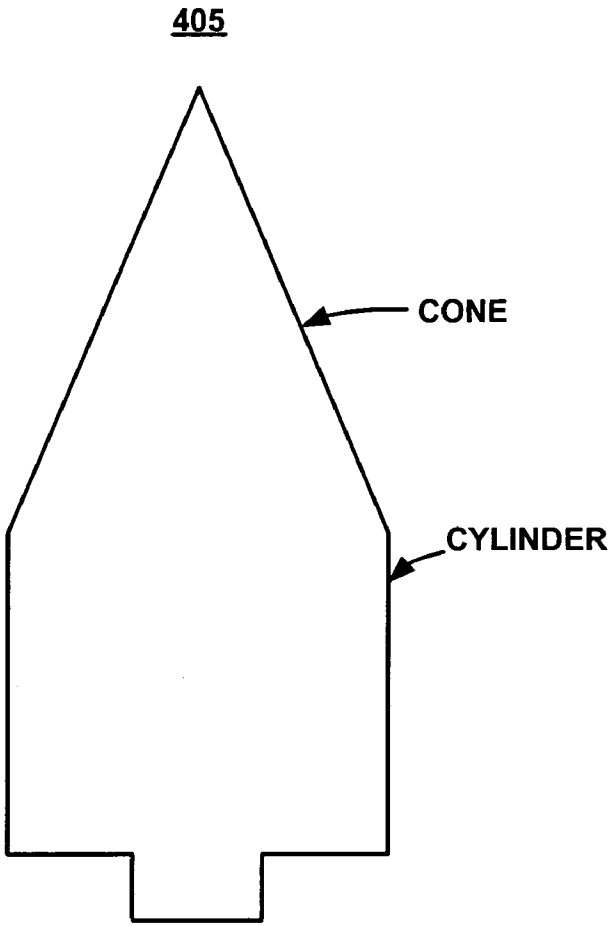
FIG. 4 is a side view of a cone-cylinder shaped nose for use in the training projectile of FIG. 1.
Figure 3:
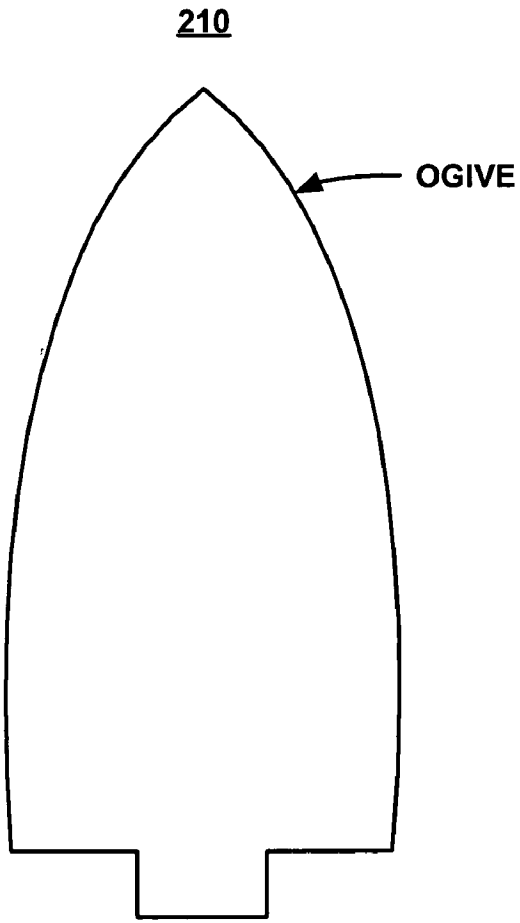
FIG. 3 is a side view of an ogive-shaped nose for use in the training projectile of FIG. 1.

The ogival shaped nose 210 is further illustrated in FIG. 3. In one embodiment, the projectile 10 comprises a cone-shaped nose 405 as illustrated by FIG. 4. In a further embodiment, the projectile 10 comprises a combination ogival/conical nose 505 as illustrated by FIG. 5. the combination ogival/conical nose 505 comprises a conical portion 510 and an ogival portion 515. The shape of the nose of projectile 10 is selected to position the center of gravity 255 of the projectile 10.

It is to be understood that the specific embodiments of the invention that have been described are merely illustrative of certain applications of the principle of the present invention. Numerous modifications may be made to a finless, cone-nosed training projectile described herein without departing from the spirit and scope of the present invention.

What is claimed is:

1. A finless training projectile disposed within a cartridge that is sized to be fired from a bore of a weapon tube, the projectile comprising:

a body including a cylindrical portion;

an obturator secured to the body;

a nose having a smooth surface, secured to a forward section of the body;

a finless tail secured to a rearward section of the body;

wherein the tail comprises a generally cylindrical tail piece and a slotted tail flange that is secured to the finless tail;

a plurality of radially angled slots formed in the slotted tail flange, wherein the slotted tail flange provides a space within the cartridge for housing a propellant;

wherein the cylindrical portion of the body includes an outer diameter that is smaller than an inside diameter of the weapon tube;

wherein the obturator provides friction fit between the weapon tube and the body of the projectile, in order to prevent forward thrust gases from escaping from the weapon tube;

wherein the plurality of radially angled slots in the slotted tail flange achieve spin after exit from the bore of the weapon tube and during flight of the training projectile, to compensate for aerodynamic and mass asymmetries; and wherein the nose provides increased mass to the nose, in order to move a center of gravity of the projectile further forward, and to allow a center of pressure of the projectile to remain in a constant rearward position relative to the center of gravity during flight, so that a distance between the center of gravity and the center of pressure remains constant throughout a Mach number range encountered during flight, thereby providing improved flight stability over an extended range.

2. The training projectile of claim 1, wherein the body and the tail are dimensioned to be fired from any one of a smooth bore or a rifled cannon of 120 mm.

3. The training projectile of claim 1, wherein the body and the tail are dimensioned to be fired from any one of a smooth bore or a rifled cannon of 105 mm.

4. The training projectile of claim 1, wherein the slotted tail flange comprises a range of approximately 2 to 6 radially angled slots that are spaced evenly around a circumference of the slotted tail flange.

5. The training projectile of claim 1, wherein the radially angled slots have a width of approximately 18.1 mm.

6. The training projectile of claim 1, wherein the radially angled slots have a depth of approximately 10.1 mm.

7. The training projectile of claim 1, wherein the tail comprises:

a cylindrical section; and wherein the cylindrical section of the tail is connected to the cylindrical portion of the body.

8. The training projectile of claim 1, wherein the radially angled slots define an angle of approximately 30 degrees with respect to an axis of the training projectile.

9. The training projectile of claim 1, wherein the body comprises an inwardly tapering section.

10. The training projectile of claim 1, wherein the weapon tube is non-rifled; and further comprises a stabilizer that is secured to the rear end of the projectile and that is formed of two integrally connected, coaxial sections of different diameters, to ensure that the projectile spins when fired from the non-rifled weapon tube.

11. The training projectile of claim 1, wherein the weapon tube includes a smooth inner surface; and further comprises a stabilizer that is secured to the rear end of the projectile and that is formed of two integrally connected, coaxial sections of different diameters, to ensure that the projectile spins when fired from the smooth inner surface of the weapon tube.

* * * * *